United States Patent [19]

Schairbaum

[11] Patent Number: 4,590,866

[45] Date of Patent: May 27, 1986

[54] WORK STATION WITH UNDERDESK DISPLAY

[76] Inventor: Edward C. Schairbaum, 3421 Stadium Dr., Fort Worth, Tex. 76109

[21] Appl. No.: 580,804

[22] Filed: Feb. 16, 1984

[51] Int. Cl.[4] ..... A47B 85/00; A47B 81/06; A47G 29/00; G09B 7/00

[52] U.S. Cl. ..... 108/23; 248/444.1; 108/28; 312/7.2; 434/323

[58] Field of Search ..... 108/23, 26, 28, 29, 108/30, 32, 4, 5, 144, 161; 434/432, 323, 324; 248/163.1, 165, 444.1; 312/7.2

[56] References Cited

U.S. PATENT DOCUMENTS

| | | | |
|---|---|---|---|
| 472,099 | 4/1892 | Wyns | 108/23 |
| 1,490,917 | 4/1924 | Finkelstein | 108/23 |
| 3,940,136 | 2/1976 | Runte | 248/1 A |

FOREIGN PATENT DOCUMENTS

| | | | |
|---|---|---|---|
| 267100 | 5/1963 | Australia | 108/161 |
| 2314690 | 2/1977 | France | 312/7.2 |

*Primary Examiner*—William E. Lyddane
*Assistant Examiner*—Gerald A. Anderson
*Attorney, Agent, or Firm*—Dressler, Goldsmith, Shore, Sutker & Milnamow, Ltd.

[57] ABSTRACT

A computer work station is described in which a work table has a transparent generally horizontal work surface, a keyboard rested upon this table, and a CRT. To make the work station more usable, the CRT is movably suspended beneath the transparent work surface so that the screen of the CRT is visible therethrough. The CRT is preferably mounted for side to side, forward and back, swingable and rotational motion so as to be movable to a variety of positions and angles beneath the transparent work surface whereby its display will be conveniently visible on many portions of the table desired by the worker.

16 Claims, 2 Drawing Figures

WORK STATION WITH UNDERDESK DISPLAY

DESCRIPTION

1. Technical Field

Figure 1:
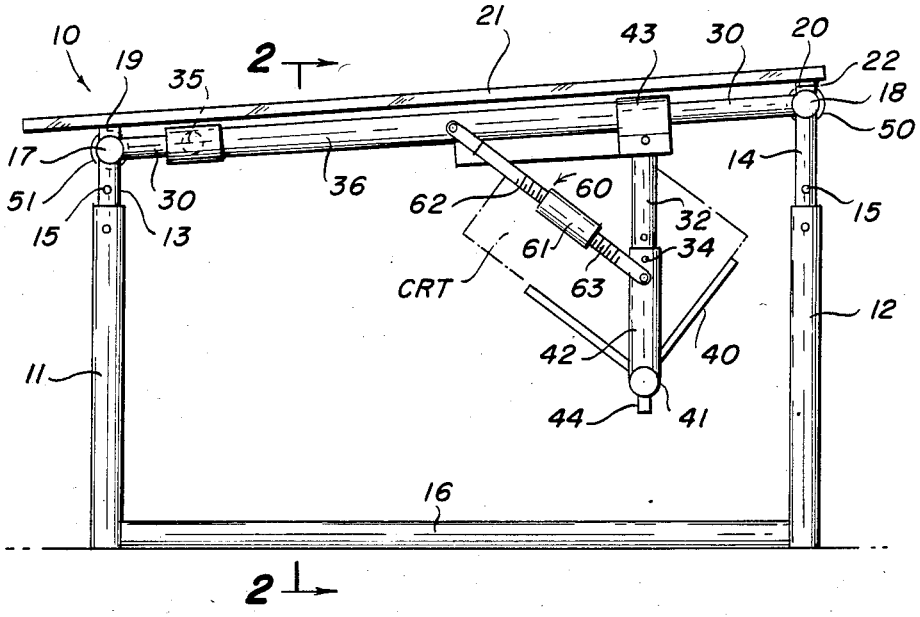

This invention relates to a computer work station in which a cathode ray tube (CRT) is positioned in a manner which enhances the user's capacity to work at the station.

2. Background Art

Computer work stations comprising a CRT and a keyboard for operating it are well known. These frequently include disc drives and printers which may be at the same or another location, but the work station always includes a CRT and a keyboard for operating the same. These are now both rested on a table, usually with the CRT immediately above and behind the keyboard.

This is a poor location for the CRT in many circumstances. It is difficult to see when the user wears glasses with bifocal lenses. It is a poor location for one who wishes to work with the data on the CRT, rather than to merely supply or change that data using the keyboard. For some tasks it is desirable to have the CRT closely associated with the keyboard, but for other tasks this is not the case.

Despite these evident limitations, there has been no satisfactory CRT location at the known work stations, and those who now use these devices must accept the limitations which presently apply.

Part of the problem may be due to the fact that it has been customary for those who work with data to be different from those who type it. The final work product is provided by several persons, the indivdual using the computer work station supplying primarily only the typing function. However, professional individuals are today finding themselves more frequently doing all sorts of tasks, including assembling the data they use, manipulating that data, and also presenting their material in a form suitable for direct print-out. Under these circumstances, the work station user must be able to perform more varied activities, and this is not easy to do with the presently constituted work stations.

DISCLOSURE OF INVENTION

In accordance with this invention, a computer work station comprises a work table having a transparent generally horizontal work surface, a keyboard rested upon the table, and a CRT, this CRT being movably suspended beneath the transparent work surface so that the screen of the CRT is visible therethrough. Since the CRT is to be movable and since, as later pointed out, the keyboard may be supported on various portions of the work table, the two are obviously movably associated with one another.

More particularly, the CRT is mounted for side-to-side, forward and back, swingable and rotational motions so as to be movable to a variety of positions and angles beneath the transparent work surface so that its display will be conveniently visible on many portions of the table desired by the worker. To accomplish this, the work table is formed with a plurality of legs which support parallel front and back horizontally extending telescoping tubes upon which the transparent work surface is supported, and the CRT mounting means including a pair of tubular supports interconnecting these horizontal tubes and slidable thereupon to permit the CRT to be moved from side to side beneath the table. A pair of tubular braces are fitted over these tubular supports and are slidable thereupon to permit the CRT to be moved forward and back beneath the table. The CRT mounting means is swingably carried by downwardly extending swing arms pivoted to these last-named tubular braces and is mounted for pivotal movement about a vertical axis. The invention includes the table which will carry the keyboard and CRT.

Also, the transparent work surface is preferably supported by raised elements carried by the front and back horizontal tubes so that the CRT mounting means can slide on the horizontal tubes without encountering the work surface.

It will also be understood that the display will be visible at a downward angle to a worker seated in front of the table. In this way, he can use bifocal lenses more conveniently. He can also write on a generally horizontal surface almost directly alongside the information which he sees on the CRT.

The table in this invention is normally formed with four legs (preferably vertically adjustable) which support the front and back horizontal tubes. These legs are adjustable to suit the user. The front legs can be placed in a lower position than the back legs to give the work surface a slight incline which some users may like for some purposes. Raised elements extend above the tubes near the four legs so that the transparent work surface, which preferably constitutes the entire top of the table, can rest above the tubes. This is one way to free the CRT mounting means for motion beneath the table. The swing-arm and the pivotal mounting permit the CRT to rotate and swing to the desired viewing position after side-to-side and forward and back motion has placed the CRT in a desired location.

Means are also used to space the front and back tubes, and the transparent work surface is preferably hinged to the back tubes so that it can be pivoted to elevate it at the front, which eases the burden of reaching the CRT to adjust some aspect of its operation. Such adjustment is sometimes required, but it is not frequently needed.

The length of the swing arms which carry the CRT is also variable because different CRTs are of different dimensions. These supports are adjusted so that the top of the CRT is just slightly beneath the undersurface of the transparent work surface. This adapts the length of the swing support to the size of the CRT by bringing the data to be read as close as possible to the user.

In preferred construction, the CRT is positioned in a right angle bracket which is at an angle to the horizontal when the swing arms extend downwardly, and this bracket is rotatably mounted upon a support which interconnects the lower ends of the swing arms.

Figure 2:
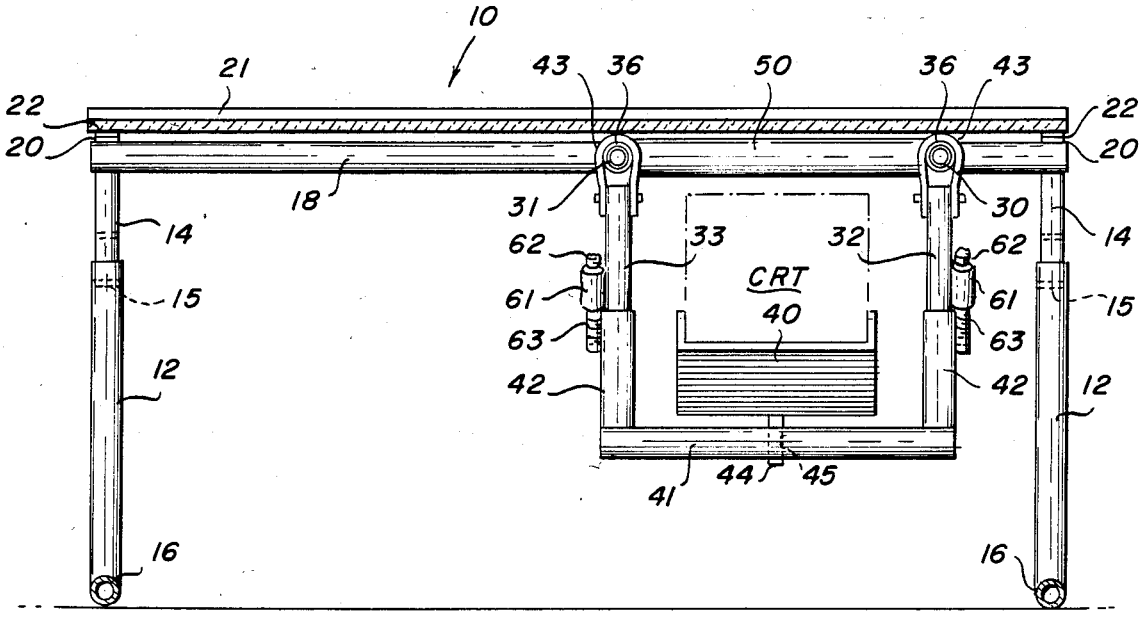
Figure 1:
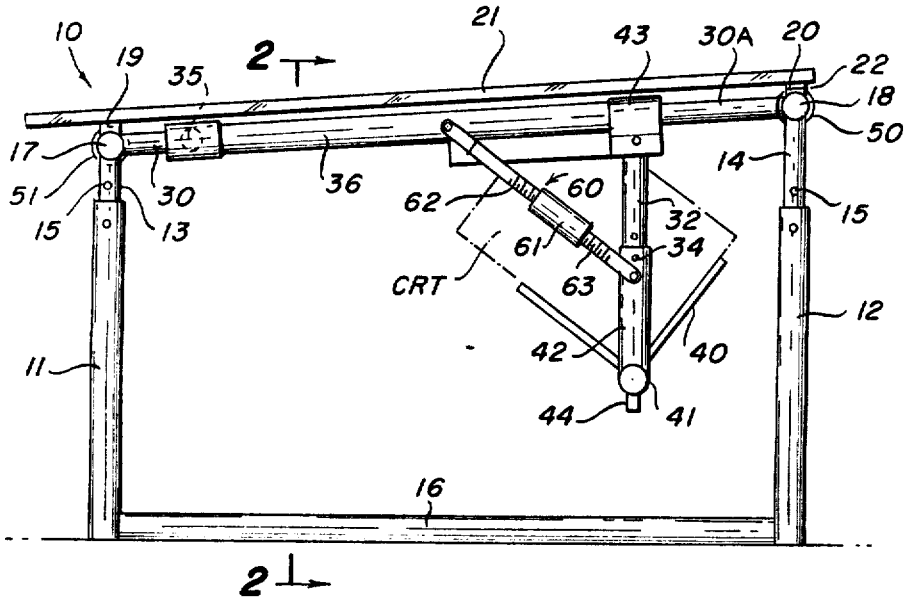
Figure 2:
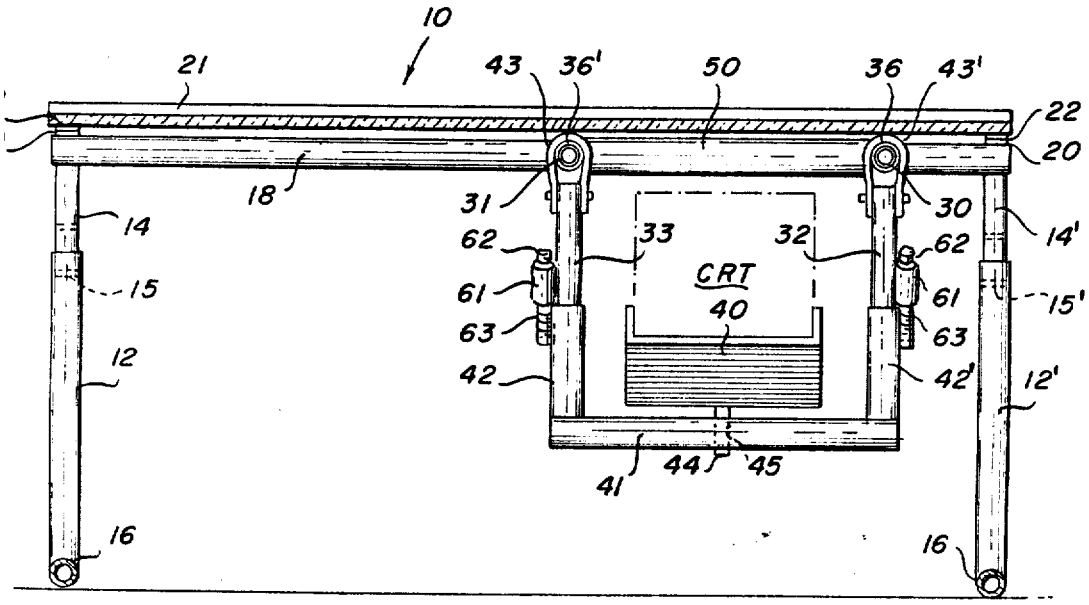
Figure 1:
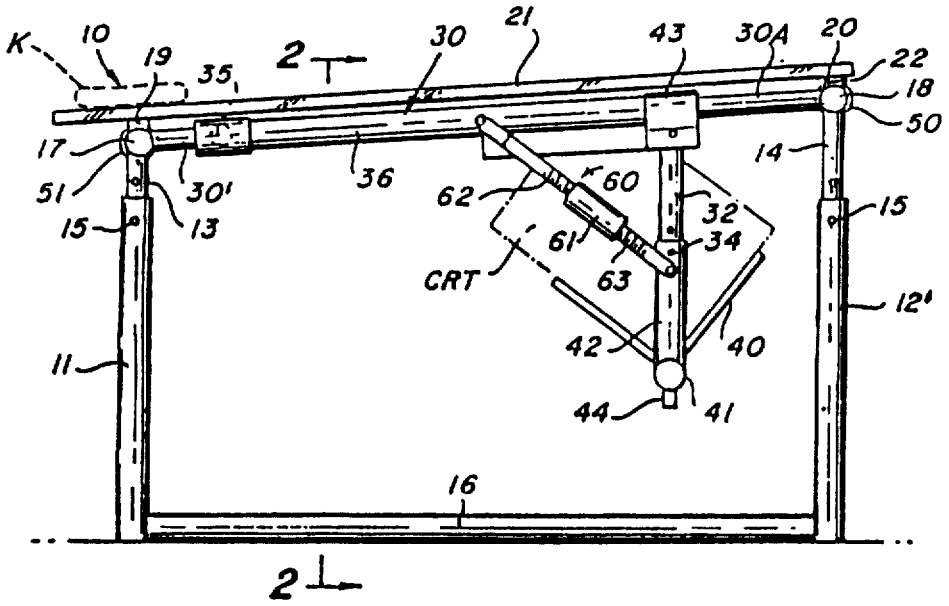
Figure 2:
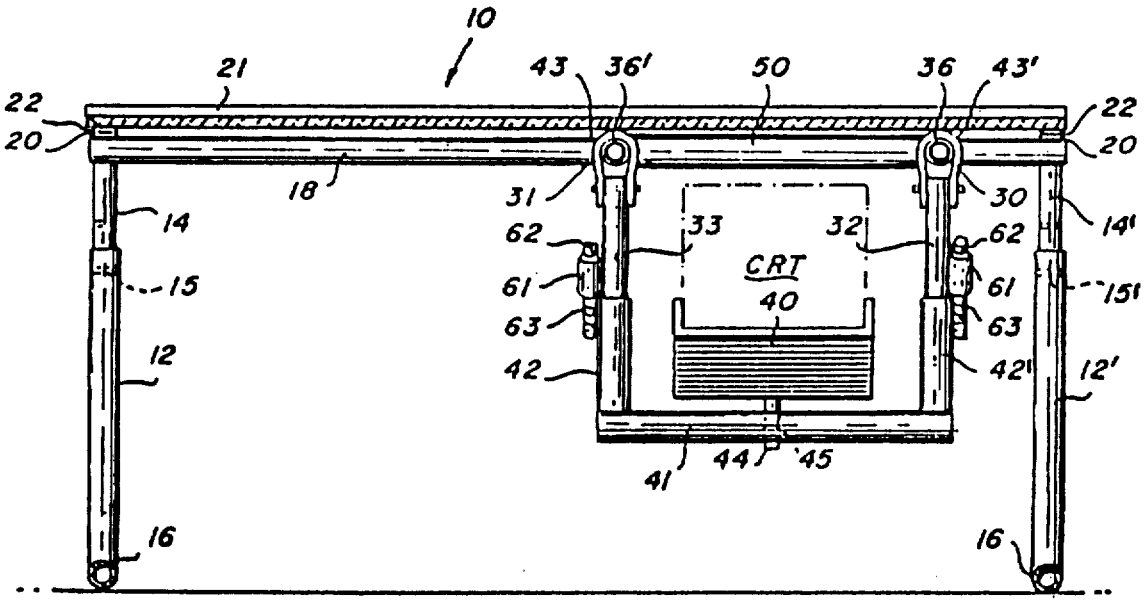

The invention will be more fully understood from the accompanying drawing in which:

FIG. 1 is an end view of a work station constructed in accordance with this invention; and FIG. 2 is a cross-section taken on the line 2—2 of FIG. 1.

Referring to FIG. 1, the numeral 10 generally identifies a table containing front legs 11 and back legs 12. As can be seen, these legs 11 and 12 are telescoped so that their upper ends 13 and 14 can be elevated to any desired position using pins 15 which are commonly used for this purpose. Clamps can be substituted. The front and back legs are spaced apart by base spacer 16. The upper ends of the front legs are interconnected by front and back tubes 17 and 18. In FIG. 1, the legs 11 and 12 are at slightly different heights to provide a slope to the work surface, but that surface can be horizontal, and the horizontal position would be preferred in many circumstances.

The front and back tubes 17 and 18 carry lifts 19 and 20 upon which are rested a transparent work surface 21, which normally would be made of glass about ⅜th inch to ½ inch in thickness. It is preferred to hinge the glass work surface 21 to the rear tube 18, one of the hinges being shown at 22.

The front and back tubes are interconnected by parallel tubes 30 and 31, only one of which can be seen in FIG. 1. These tubes 30 and 31 are each made in three telescoped sections. Thus, tube 30 more particularly includes tube ends 30 and 30A and central portion 36, while tube 31 more particularly includes tube end 31, central portion 36', and a remote tube end, like tube end 30A, not shown, including a central larger diameter portion 36 which carries the CRT via swing arms 32 and 33 which telescope with respect to lower portions 42 and are adjustable in length via pins 34. Tubes 30 and 31 are spaced apart by a spacing bar 35 which is secured to a central portion of these tubes, as will be discussed, and preferably positioned, as shown, near the front of the table.

The CRT is supported on a right angle bracket 40 which is rotatably mounted on a horizontal support 41. In this illustration of the invention, the rotatable mounting is by a downward spindle 44 fixed to the bottom of bracket 40 and which is extended through a hole in the support 41. The CRT is shown in phantom, and is simply placed on the bracket 40 which may have openings therein to allow cables to interconnect the CRT with the remaining portions of the computer. As shown in FIG. 1, the CRT is positioned so that its screen or display is at an angle to the work surface 21 to be visible from the front of the table.

Support 41 is carried at the lower ends 42 and 42' of telescoping swing arms 32 and 33, and these are pivotally mounted at their upper ends by means of collars 43 and 43' which are secured to the portions 36 and 36' of tubes 30 and 31. Since the portions 36 are slidably disposed on the tubes 30 and 31, this means that the CRT can be shifted front to back by manual operation.

The side to side shifting of the CRT is more fully shown in FIG. 2 where it will be seen that the back tube 18 has mounted thereon a larger diameter tube 50 and the tubes 30 and 31 are connected thereto. In this way as the tube 50 slides laterally along the back tube 18 (a corresponding element 51 will slide laterally along the front tube 17 the tubes 30 and 31 are shifted laterally, and the CRT is shifted laterally along with them.

It is desired to be able to swing the swing arms 32 and 33 in order to position the angle of the CRT, and this is done by means of the element 60 which is of variable length as a result of the combination of a central collar 61 with threaded bars 62 and 63. Bar 62 is pivotally connected to the tube 36 and bar 63 is pivotally connected to a lower portion 42 of the swing arm 32. One or two of these may be used as desired, and it is well known that rotation of the collar will vary the length of the combined bars so as to position the swing arm and thereby vary the angle of the CRT.

To summarize the operation, the table is adjusted to the user by choosing the lengths of the legs 11 and 12 via the placing of pins 15. The CRT is placed on bracket 40 and its elevation selected by appropriately placing pins 34. The lateral position of the CRT is adjusted by pushing the assembly which carries the CRT to the side which causes tubes 50 and 51 to slide over tubes 17 and 18. The forward to back position is obtained by pushing the assembly which carries the CRT forward or back to cause large diameter tubes 36 to slide over tubes 30 and 31. It will be seen that these tubes 30 and 31 are formed in several sections so that the height of legs 11 and 12 may differ from one another. When the CRT is positioned, as above indicated, it can now be rotated by turning spindle 44 in the vertical hole 45 in the support 41 to allow easy viewing. The collar 61 is now used to vary the length of the element 60 which moves the swing arms 32 and 33 to adjust the angle of the CRT.

It should be observed that a tubular construction has been illustrated, and this is the presently preferred form of the invention. These tubes are preferably round, but any slidable construction can be used. Moreoever, a sliding construction represents only one particularly practical means for movably supporting the CRT beneath the transparent work surface, and other constructions, such as jointed support arms, will be apparent to those skilled in the art. Also, and while it is presently preferred to have the entire upper surface of the desk transparent, a portion thereof may be of conventional opaque construction so long as a sufficient transparent surface remains so that several executive functions can be carried out on different portions of the transparent surface with the CRT being moved to facilitate such functions. This is illustrated by the fact that one might wish to support a telephone and the keyboard on non-transparent portions of the table or desk.

What is claimed is:

1. A computer work station comprising a work table having a transparent generally horizontal work surface, a CRT, a keyboard movably associated with said CRT, and means to suspend said CRT beneath said transparent work surface with the screen of said CRT at an angle to said work surface so that the screen of the CRT is visible therethrough at a downward angle to a worker using the work station, and said means to suspend said CRT including means for moving said CRT to a variety of positions and angles beneath the transparent work surface whereby its display will be conveniently visible to said worker at many positions about the table.

2. A computer work station as recited in claim 1 in which said work table is formed with a plurality of legs which support parallel front and back horizontally extending telescoping tubes above which said transparent work surface is supported, said CRT mounting means including a pair of tubular supports interconnecting said horizontal tubes and slidable therewith as said tubes are telescoped to permit the CRT to be moved from side to side beneath the table.

3. A computer work station as recited in claim 2 in which a pair of tubular braces are fitted over said last-named tubular supports and are slidable thereupon to permit the CRT to be moved forward and back beneath the table.

4. A computer work station as recited in claim 3 in which said CRT mounting means is carried by downwardly extending swing arms pivoted to said last-named tubular braces.

5. A computer work station as recited in claim 4 in which said transparent work surface is supported by raised elements carried by said front and back horizontal tubes so that the CRT mounting means can slide on said horizontal tubes without encountering the work surface.

6. A computer work station as recited in claim 5 in which said transparent work surface constitutes the entire top of the table, and is hinged at the back to slope said work surface.

7. A computer work station as recited in claim 4 in which said legs are adjustable in length to adapt the height of the table to the user, and the length of said downwardly extending swing arms is adjustable to adapt the length of the swing arms to the size of the CRT.

8. A computer work station as recited in claim 7 in which said CRT is positioned in a right angle bracket which is at an angle to the horizontal when the swing arms extend downwardly, and said bracket is rotatably mounted upon a support which interconnects the lower ends of said swing arms.

9. A work table adapted to provide a computer work station comprising a transparent generally horizontal work surface adapted to support a keyboard rested thereupon, said work table having means to movably suspend said CRT beneath said transparent work surface with the screen of said CRT at an angle to said work surface so that the screen of the CRT is visible therethrough at a downward angle to a worker seated in front of the table, said suspending means to move said CRT from side to side, forward and back, swingably and rotationally so as to be movable to a variety of positions and angles beneath the transparent work surface whereby its display will be conveniently visible on many portions of the table desired by the worker.

10. A work table as recited in claim 9 in which said table is formed with a plurality of legs which support parallel front and back horizontally extending telescoping tubes upon which said transparent work surface is supported.

11. A work table as recited in claim 10 in which tubular supports extend between said horizontal tubes a with pair of tubular braces being fitted over said last-named tubular supports and slidable thereupon to permit the CRT to be moved forward and back beneath the table.

12. A work table as recited in claim 11 in which said CRT suspending means is carried by downwardly extending swing arms pivoted to said last-named tubular braces.

13. A work table as recited in claim 12 in which said transparent work surface is supported by raised elements carried by said front and back horizontal tubes so that the CRT suspending means can slide on said horizontal tubes without encountering the work surface.

14. A work table as recited in claim 13 in which said transparent work surface is hinged at the back to be elevatable at the front.

15. A work table as recited in claim 14 in which said legs are adjustable in length to adapt the height of the table to the user, and the length of said downwardly extending swing arms is adjustable to adapt the length of the swing arms to the size of a selected CRT.

16. A work table as recited in claim 15 in which a right angle bracket adapted to support a CRT is mounted on a support which interconnects the lower ends of said swing arms, said right angle bracket being positioned at an angle to the horizontal when the swing arms extend downwardly, and said bracket is rotatably mounted said support to permit rotation of said CRT about a vertical axis.

* * * * *

UNITED STATES PATENT AND TRADEMARK OFFICE

CERTIFICATE OF CORRECTION

PATENT NO. : 4,590,866

DATED : May 27, 1986

INVENTOR(S) : Edward C. Schairbaum

It is certified that error appears in the above-identified patent and that said Letters Patent is hereby corrected as shown below:

Column 3, line 51, after "17", add: --)--.

Column 6, lines 4 and 5 (lines 2 and 3 of claim 11), change "a with pair" to read: --with a pair--.

The title page should be deleted to appear as per attached title page. The sheet of drawing consisting of Figures 1 and 2 should be deleted to appear as per attached sheet.

Signed and Sealed this

*Twelfth* Day of *August 1986*

[SEAL]

*Attest:*

*Attesting Officer*

DONALD J. QUIGG

*Commissioner of Patents and Trademarks*

United States Patent [19]

Schairbaum

[11] Patent Number: 4,590,866

[45] Date of Patent: May 27, 1986

[54] WORK STATION WITH UNDERDESK DISPLAY

[76] Inventor: Edward C. Schairbaum, 3421 Stadium Dr., Fort Worth, Tex. 76109

[21] Appl. No.: 580,804

[22] Filed: Feb. 16, 1984

[51] Int. Cl.[4] ..... A47B 85/00; A47B 81/06; A47G 29/00; G09B 7/00

[52] U.S. Cl. ..... 108/23; 248/444.1; 108/28; 312/7.2; 434/323

[58] Field of Search ..... 108/23, 26, 28, 29, 108/30, 32, 4, 5, 144, 161; 434/432, 323, 324; 248/163.1, 165, 444.1; 312/7.2

[56] References Cited

U.S. PATENT DOCUMENTS

| | | | |
|---|---|---|---|
| 472,099 | 4/1892 | Wyns | 108/23 |
| 1,490,917 | 4/1924 | Finkelstein | 108/23 |
| 3,940,136 | 2/1976 | Runte | 248/1 A |

FOREIGN PATENT DOCUMENTS

| | | | |
|---|---|---|---|
| 267100 | 5/1963 | Australia | 108/161 |
| 2314690 | 2/1977 | France | 312/7.2 |

*Primary Examiner*—William E. Lyddane
*Assistant Examiner*—Gerald A. Anderson
*Attorney, Agent, or Firm*—Dressler, Goldsmith, Shore, Sutker & Milnamow, Ltd.

[57] ABSTRACT

A computer work station is described in which a work table has a transparent generally horizontal work surface, a keyboard rested upon this table, and a CRT. To make the work station more usable, the CRT is movably suspended beneath the transparent work surface so that the screen of the CRT is visible therethrough. The CRT is preferably mounted for side to side, forward and back, swingable and rotational motion so as to be movable to a variety of positions and angles beneath the transparent work surface whereby its display will be conveniently visible on many portions of the table desired by the worker.

16 Claims, 2 Drawing Figures

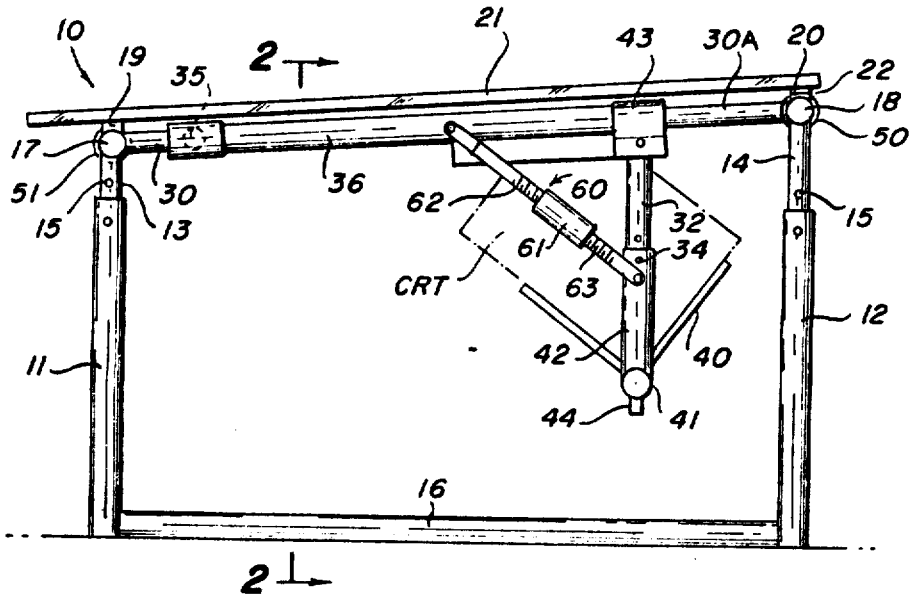

Patent No. 4,590,866

May 27, 1986

UNITED STATES PATENT AND TRADEMARK OFFICE

CERTIFICATE OF CORRECTION

PATENT NO. : 4,590,866

DATED : May 27, 1986

INVENTOR(S) : Edward C. Schairbaum

It is certified that error appears in the above-identified patent and that said Letters Patent is hereby corrected as shown below:

Col. 2, line 7, delete "vertical" and insert --horizontal--;

Col. 2, line 68, delete "and back tubes" and insert "tube", and after "17 and", insert --the upper ends of the back legs are interconnected by back tube--.

Col. 3, line 15, delete "30" and insert --30'--;

Col. 3, line 16, delete "31" and insert --, not shown, --;

Col. 3, lines 17 and 18, delete "like tube end 30A,";

Col. 3, line 19, delete "36";

UNITED STATES PATENT AND TRADEMARK OFFICE

CERTIFICATE OF CORRECTION

PATENT NO. : 4,590,866

DATED : May 27, 1986

INVENTOR(S) : Edward C. Schairbaum

It is certified that error appears in the above-identified patent and that said Letters Patent is hereby corrected as shown below:

Col. 3, line 21, delete "42", insert --42' and 42, respectively,--;

Col. 3, line 21, after "are", insert --each--;

Col. 3, line 29, after "is", insert --provided--;

Col. 3, line 33, after "therein", insert --, not shown, --;

Col. 3, line 33, after "cables", insert --, not shown, --;

Col. 3, line 34, after "computer" and before the period, insert --, not shown, --;

UNITED STATES PATENT AND TRADEMARK OFFICE

CERTIFICATE OF CORRECTION

PATENT NO. : 4,590,866

DATED : May 27, 1986

INVENTOR(S) : Edward C. Schairbaum

It is certified that error appears in the above-identified patent and that said Letters Patent is hereby corrected as shown below:

Col. 3, line 37, after "table" and before the period, insert --10--;

Col. 3, line 55, after "the", insert --pair of--;

Col. 3, line 55, delete "element" and insert --elements--;

Col. 3, line 55, after "60", insert --each of--;

Col. 3, line 57, delete "Bar" and insert --As illustrated in Fig. 1, bar--;

Col. 3, line 61, after "collar", insert --61--;

UNITED STATES PATENT AND TRADEMARK OFFICE

CERTIFICATE OF CORRECTION

PATENT NO. : 4,590,866

DATED : May 27, 1986

INVENTOR(S) : Edward C. Schairbaum

It is certified that error appears in the above-identified patent and that said Letters Patent is hereby corrected as shown below:

Col. 3, line 62, after "bars", insert --62 and 63--;

Col. 3, line 62, after "the" (second occurrence), insert --associated--;

Col. 3, line 62, after "arm", insert --32 or 33--;

Col. 3, line 64, after "table" insert --10--;

Col. 3, line 68, after "34" and before the period insert --and adjusting the bar 61--.

Col. 4, line 5, after "36", insert --and 36'--;

UNITED STATES PATENT AND TRADEMARK OFFICE

CERTIFICATE OF CORRECTION

PATENT NO. : 4,590,866

DATED : May 27, 1986

INVENTOR(S) : Edward C. Schairbaum

It is certified that error appears in the above-identified patent and that said Letters Patent is hereby corrected as shown below:

Col. 4, between lines 13 and 14, insert the following new paragraph:

--Shown in Fig. 1 in phantom is an end view of a keyboard K resting upon table 10. Keyboard K is interconnected by cables, not shown, with portions of the computer, not shown, and with the CRT. The keyboard is moveable over work surface 21 to various locations.--

The title page should be deleted to appear as per attached title page. Figure 1 should be deleted to appear as per Figure 1 on the attached title page.

Signed and Sealed this

Seventh Day of July, 1992

*Attest:*

DOUGLAS B. COMER

*Attesting Officer*

*Acting Commissioner of Patents and Trademarks*

United States Patent [19]
Schairbaum

[11] Patent Number: 4,590,866
[45] Date of Patent: May 27, 1986

[54] WORK STATION WITH UNDERDESK DISPLAY

[76] Inventor: Edward C. Schairbaum, 3421 Stadium Dr., Fort Worth, Tex. 76109

[21] Appl. No.: 580,804

[22] Filed: Feb. 16, 1984

[51] Int. Cl.[4] ..... A47B 85/00; A47B 81/06; A47G 29/00; G09B 7/00

[52] U.S. Cl. ..... 108/23; 248/444.1; 108/28; 312/7.2; 434/323

[58] Field of Search ..... 108/23, 26, 28, 29, 108/30, 32, 4, 5, 144, 161; 434/432, 323, 324; 248/163.1, 165, 444.1; 312/7.2

[56] References Cited

U.S. PATENT DOCUMENTS

| | | | |
|---|---|---|---|
| 472,099 | 4/1892 | Wyns | 108/23 |
| 1,490,917 | 4/1924 | Finkelstein | 108/23 |
| 3,940,136 | 2/1976 | Runte | 248/1 A |

FOREIGN PATENT DOCUMENTS

| | | | |
|---|---|---|---|
| 267100 | 5/1963 | Australia | 108/161 |
| 2314690 | 2/1977 | France | 312/7.2 |

*Primary Examiner*—William E. Lyddane
*Assistant Examiner*—Gerald A. Anderson
*Attorney, Agent, or Firm*—Dressler, Goldsmith, Shore, Sutker & Milnamow, Ltd.

[57] ABSTRACT

A computer work station is described in which a work table has a transparent generally horizontal work surface, a keyboard rested upon this table, and a CRT. To make the work station more usable, the CRT is movably suspended beneath the transparent work surface so that the screen of the CRT is visible therethrough. The CRT is preferably mounted for side to side, forward and back, swingable and rotational motion so as to be movable to a variety of positions and angles beneath the transparent work surface whereby its display will be conveniently visible on many portions of the table desired by the worker.

16 Claims, 2 Drawing Figures

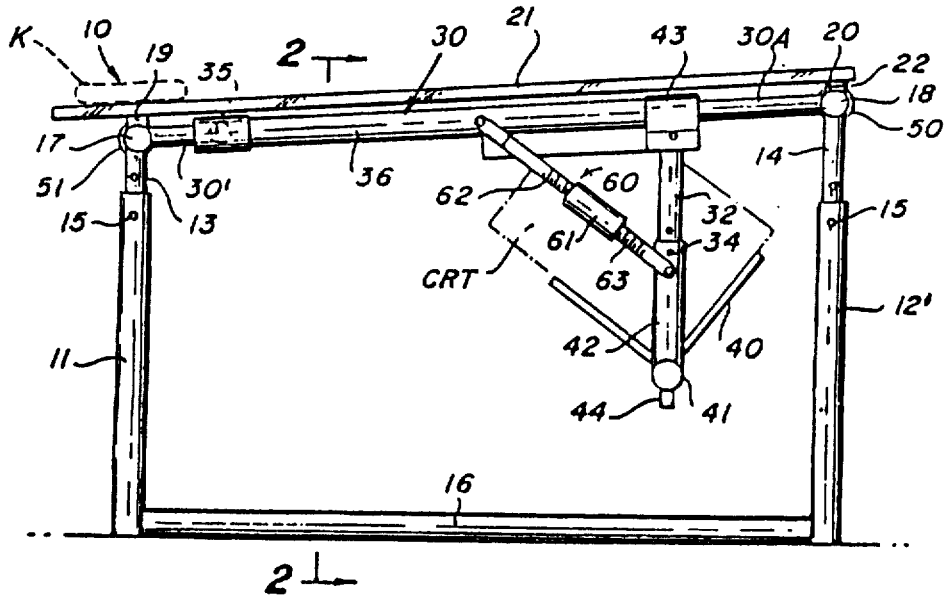

Patent No. 4,590,866